US006019620A

United States Patent [19]

Kodama et al.

[11] Patent Number: 6,019,620

[45] Date of Patent: Feb. 1, 2000

[54] DEVICE HAVING ENGAGING LEVERS FOR CONNECTING ELECTRICAL MEMBERS

[75] Inventors: Shinji Kodama; Toshiaki Ozawa, both of Shizuoka, Japan

[73] Assignee: Yazaki Corporation, Tokyo, Japan

[21] Appl. No.: 09/108,179

[22] Filed: Jul. 1, 1998

[30] Foreign Application Priority Data

Jul. 1, 1997 [JP] Japan ..... 9-175882

[51] Int. Cl.[7] ..... H01R 13/62

[52] U.S. Cl. ..... 439/157; 439/372

[58] Field of Search ..... 439/157, 372, 439/152, 153

[56] References Cited

U.S. PATENT DOCUMENTS 5,711,682 1/1998 Maejima ..... 439/157

5,873,745 2/1999 Dulos et al. ..... 439/157

*Primary Examiner*—Khiem Nguyen

*Assistant Examiner*—Michael C. Zarroli

*Attorney, Agent, or Firm*—Sughrue, Mion, Zinn, Macpeak & Seas, PLLC

[57] ABSTRACT

A lever fitting connector for connecting electrical members includes a female connector having a hood-like outer peripheral wall, a male connector fitted into the female connector and an operation lever body pivotally supported on an outer face of a side wall of the male connector. An engaging projection is provided at one end of the operation lever body, for engaging with the outer peripheral wall of the female connector. An operation portion is provided at the other end of the operation lever body. A cooperation lever is supported pivotally on the outer face of the side wall of the male connector. One end of the cooperation lever is connected with the operation lever body, and an engaging projection is placed at the other end thereof. When the operational portion of the operation lever is pressed, the engaging projection of the operation lever is pivotally moved about a portion where the engaging projection is engaged with the outer peripheral wall. Similarly, the cooperation lever is pivotally moved about a portion where the engaging projection of the cooperation lever is engaged with the outer peripheral wall of the female connector. As a result, the male connector is fitted into the female connector.

14 Claims, 10 Drawing Sheets

DEVICE HAVING ENGAGING LEVERS FOR CONNECTING ELECTRICAL MEMBERS

BACKGROUND OF THE INVENTION

1. Field of the Invention

This present invention relates to a lever fitting connector in which female and male connectors are fitted together by operating a lever.

2. Background of the Related Art

FIGS. 15 and 16 show a frame connecting connector 1 disclosed in Unexamined Japanese Patent Publication No. Hei 6-251826. The connector 1 comprises: a female connector section 3 which is disposed on a box main body 2 such as an electrical junction box; a male connector 5 which is to be inserted and fitted into a hood portion 4 of the female connector section 3; and a frame 6 which causes the male connector 5 to be inserted and fitted into the female connector section 3. The frame 6 consists of a main body 7 in which the male connector 5 is rotatably housed, a rotation leg 8 which protrudes from one end of the main body 7, and an operating projection 9 which projects from the other end. A sliding shaft 10 is formed at the tip end portion of the rotation leg 8. The sliding shaft 10 is inserted into and engagingly held to a slide groove 12 of a frame support 11 which is disposed in the periphery of the female connector section 3.

As shown in FIG. 16, the sliding shaft 10 is engagingly held in the slide groove 12, and the operating projection 9 is pressed so that the frame 6 is rotated in the direction of the arrow A about the sliding shaft 10, whereby the male connector 5 is inserted and fitted into the female connector section 3. In the state that the male connector 5 is fitted into the female connector section 3, the operating projection 9 is pressed in the reverse direction so that the frame 6 is rotated in the direction opposite to that of the arrow A, whereby the male connector 5 is removed from the hood portion 4 of the female connector section 3.

In this case, the sliding shaft 10 functions as the fulcrum, so that the operating projection 9 becomes a point where force is applied. The portion of the male connector 5 which is rotatably supported by the frame 6 becomes a point of action, thereby enabling the male connector 5 to be fitted into the female connector section 3 with a small force. Therefore, the operating force to be exerted when the male connector 5 is fitted into the female connector section 3 can be reduced.

In the above frame connecting connector 1, however, the support portion 5*a*, at which the male connector 5 is pivotally supported on the frame 6, is provided at only one portion in the vicinity of a substantially central portion of the male connector 5. Therefore, if the male connector 5 is long, it is tilted when it is inserted into the hood portion 4. As a result, the operating force required for this inserting operation increases.

Furthermore, in the above frame connecting connector 1, if the fitting resistance, which is developed when fitting the male connector 5 into the female connector portion 3, is uneven, the male connector 5 is tilted when the male connector 5 is to be inserted into the hood portion 4. More specifically, the male connector may be tilted if a fitting force, required for fitting terminals which are provided at one side portion of the male connector 5, is larger than the fitting force required for fitting the terminals provided at the other side portion of the male connector 5. This causes the terminals at one side portion to be connected together earlier while the terminals at the other side portion are connected together later. Therefore, the fitting load is increased, and also the operating force is increased, so that the leverage effect by the frame 6 is lowered.

SUMMARY OF THE INVENTION

It is therefore an object of this present invention to provide a lever fitting connector in which a male connector can be easily inserted and fitted into a hood portion of a female connector portion without tilting.

In order to achieve the above object, there is provided a lever fitting connector comprising a female connector having a hood-like outer peripheral wall and a male connector fitted into the female connector. An operation lever body is supported pivotally on an outer face of a side wall of the male connector. An engaging projection is provided at one end of the operation lever body, for engaging with the outer peripheral wall of the female connector, and an operation portion is provided at the other end of the operation lever body. A cooperation lever is supported pivotally on the outer face of the side wall of the male connector, one end of the cooperation lever is connected with the operation lever body and the other end of the cooperation lever has an engaging projection.

When the engaging projection of the operation lever is pivotally moved about a portion where the engaging projection of the operation lever is engaged with the outer peripheral wall of the female connector by pressing the operation portion of the operation lever, the cooperation lever is pivotally moved about a portion where the engaging projection of the cooperation lever is engaged with the outer peripheral wall of the female connector consequently, thereby the male connector is fitted into the female connector.

In this manner, for inserting and fitting the male connector into the female connector, the male connector is positioned relative to the female connector, and then the fitting side of the male connector is inserted into the female connector. When the fitting side of the male connector is inserted into the female connector, the engaging projection at one end of each lever wall is retained on the outer peripheral wall of the female connector, and also the engaging projection at the other end of the cooperation lever is retained on the outer peripheral wall of the female connector.

In this condition, when the operating portion of the operation lever is operated to pivotally move the operation lever body, the operation lever body is pivotally moved about the portion of the engaging projection retained on the female connector, thereby pressing the male connector into the female connector. In accordance with the pivotal movement of the operation lever body, the cooperation lever is pivotally moved about the portion of the engaging projection retained on the female connector, thereby pressing the male connector into the female connector. Therefore, when the operation lever body is operated, the operation lever body and the cooperation lever are simultaneously pivotally moved, thereby fitting the male connector into the female connector.

In this manner, through two support portions, that is, a support portion at which the operation lever body is pivotally supported on the male connector, and a support portion at which the cooperation lever is pivotally supported on the male connector, the male connector is pressed into the female connector. Therefore, even if the male connector is long, the male connector can be inserted into the female connector without tilting. Thus, the fitting force will not increase, and the operating force will not increase.

According to the present invention, the female connector may further include at least one intermediate wall in the outer peripheral wall. The cooperation lever may include a plurality of cooperation lever bodies. One end of each cooperation body is connected with the operation lever body, each cooperation body has an engaging projection at the other end thereof. One of the engaging projections provided on the plurality of cooperation lever bodies is engaged with the outer peripheral wall of the female connector. The other engaging projections of the plurality of cooperation levers are engaged with the intermediate wall of the female connector.

In this manner, when the operation lever is operated to pivotally move each operation lever body about the portion of the engaging projection retained on the female connector, each of the plurality of cooperation levers is also pivotally moved about the portion of the engaging projection retained on the female connector, thereby inserting the male connector into the female connector.

In this case, not only through the support portion, at which the operation lever body is pivotally supported on the male connector, but also through the support portions at which the plurality of cooperation levers are pivotally supported on the male connector, respectively, the male connector is pressed into the female connector. Therefore, even if the connector has a long length, the male connector can be inserted into the female connector without tilting.

According to the present invention, at least one of a support portion at which the operation lever body is supported on the male connector, and a support portion at which the cooperation lever is supported on the male connector, may be disposed at a portion of the male connector at which a larger fitting resistance is encountered when the male connector is fitted into the female connector.

In this manner, the male connector can be efficiently pressed into the female connector through the leverage of the operation lever and cooperation lever, and the male connector can be inserted into the female connector without tilting According to the present invention, the portion of the cooperation lever that is connected with the operation lever body is located between the support portion at which the operation lever body is supported on the male connector and the support portion at which the cooperation lever is supported on the male connector.

In this manner, simultaneously when the operation lever body is pivotally moved, the cooperation lever is pivotally moved, thereby pressing the male connector into the female connector through the support portions at which the levers are supported on the male connector, respectively. In this case, since the connection portion of the operation lever body and the cooperation lever is located between the support portion at which the operation lever body is supported on the male connector and the support portion at which the cooperation lever is supported on the male connector, the male connector can be pressed into the female connector uniformly through the support portions.

According to the present invention, the portion of the cooperation lever which is connected with the operation lever body may be located outside of an area between the support portion at which the operation lever body is supported on the male connector and the support portion at which the cooperation lever is supported on the male connector.

In this manner, for example, one support portion can be disposed at a portion of the male connector at which a large fitting resistance is encountered, and another support portion can be provided at a portion where another large fitting resistance is encountered.

According to the present invention, the lever fitting connector may further include provisional fixing members for provisionally fixing the operation lever body in a position so that the engaging projections of the operation lever body and the engaging projection of the cooperation lever do not project from the male connector.

In this manner, before the male connector is fitted into the female connector, the operation lever body is held in the provisional fixing position by the provisional fixing members. In this condition, the engaging projections of the operation lever body and cooperation lever do not project from the side faces of the male connector. Therefore, when the fitting side of the male connector is to be inserted into the female connector, the engaging projections of the operation lever body and the cooperation lever will not prevent this fitting operation.

According to the present invention, the provisional fixing members may include a provisional fixing arm projecting from the operating lever body and having a retaining hole therein. A provisional fixing projection formed on the male connector which is releasably engaged with the retaining hole to provisionally retain the operating lever body in the provisional fixing position. A release projection formed on an inner face of the outer peripheral wall of the female connector, to flex the provisional fixing arm and thereby release the retaining engagement of the provisional fixing projection by the pivotal movement of the operation lever body when the male connector is fitted into the female connector.

In this manner, the operation lever body of the operation lever and the cooperation lever are held in their respective provisional fixing positions by the provisional fixing members (that is, the provisional fixing projection, formed on the male connector, is releasably engaged in the retaining hole in the provisional fixing arm projecting from the operation lever body). In this condition the fitting side of the male connector is inserted into the female connector, and when the operation lever body is pivotally moved, the cooperation lever is pivotally moved at the same time, so that the engaging projections of the operation lever body and the cooperation lever are retained on the female connector. When the operation lever body is further pivotally moved, the provisional fixing arm abuts against the release projection on the inner face of the outer peripheral wall of the female connector, and is flexed, thereby releasing the retaining engagement of the provisional fixing projection in the retaining hole. As a result, the operation lever body and the cooperation lever can be pivotally moved, and when the operation lever body is operated, the cooperation lever is simultaneously pivotally moved respectively about the portions of the engaging projections of the operation lever body and the cooperation lever retained on the female connector, thereby inserting the male connector deeper into the female connector.

According to the present invention, the connection portion of the operation lever body and the cooperation lever may include a connection shaft projecting from one of the operation lever body and the cooperation lever, and a slot formed in the other and supporting the connection shaft so as to be movable along the slot.

In this manner, when the operation lever body is pivotally moved, the cooperation lever is also pivotally moved simultaneously with the pivotal movement of the operation lever body. At this time, the connection shaft, formed for example on the operation lever body, moves along the slot in the cooperation lever, so that the cooperation lever can be pivotally moved with almost no resistance in cooperation with the pivotal movement of the operation lever body.

DETAILED DESCRIPTION OF THE PREFERRED EMBODIMENTS

A preferred embodiment of a lever fitting connector of the present invention will be described below in detail with reference to the drawings.

First Embodiment

Figure 1:
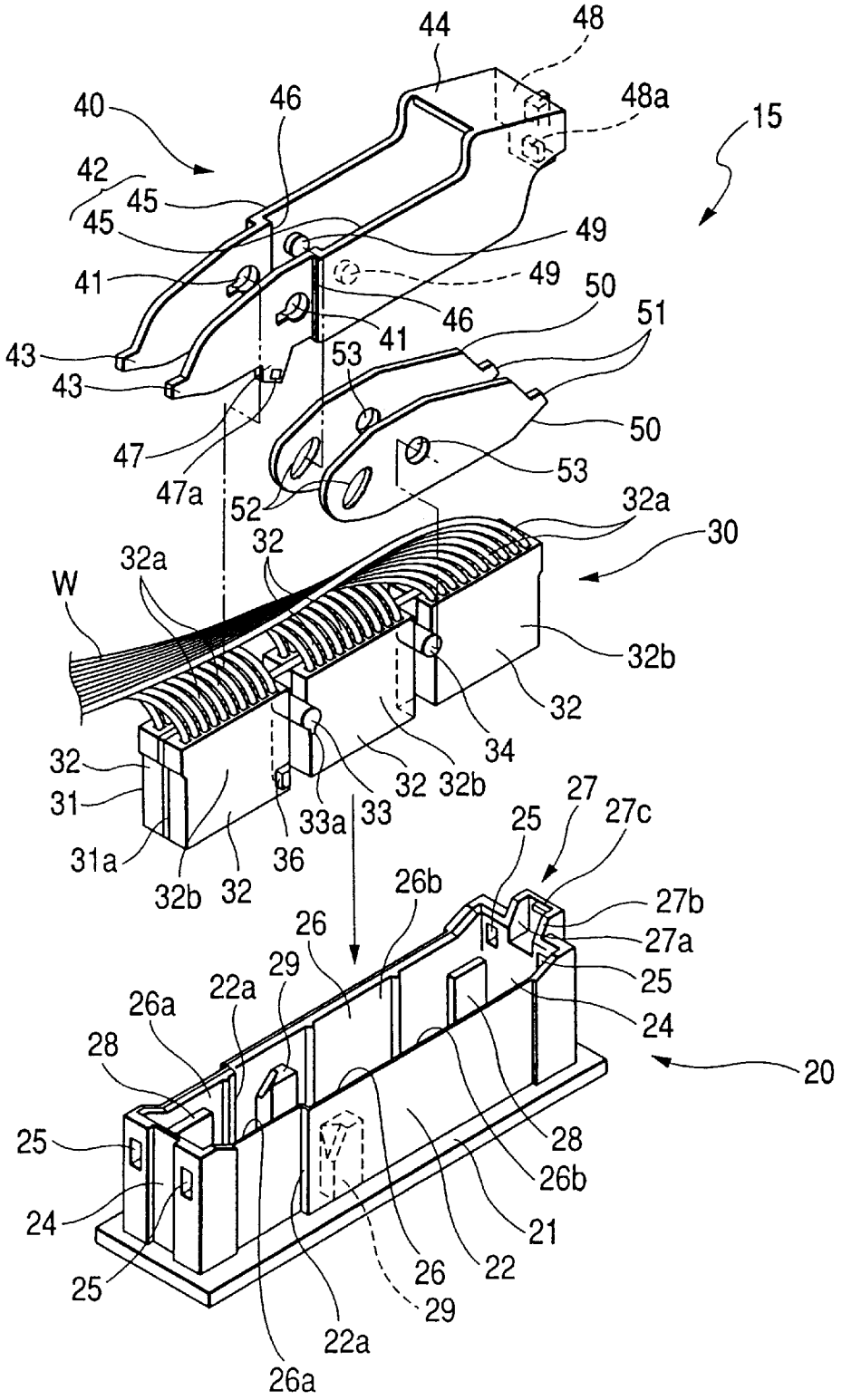
FIG. 1 is an exploded, perspective view of a first embodiment of a lever fitting connector of the present invention.
Figure 2:
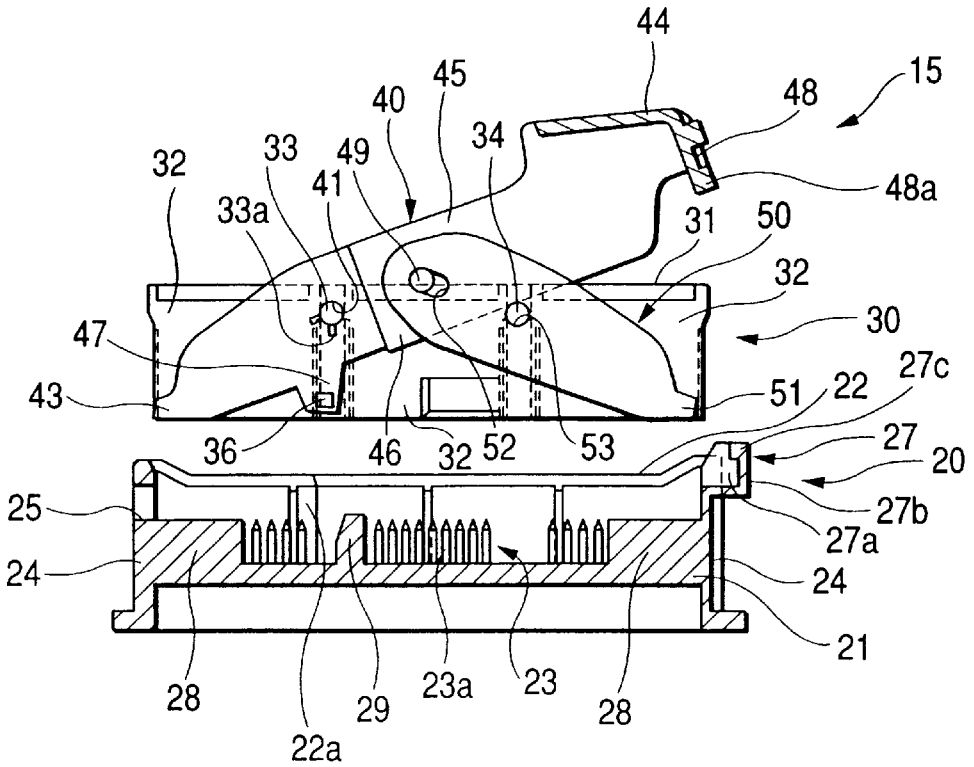
FIG. 2 is a cross-sectional view of the lever fitting connector of the first embodiment, showing a condition before a male connector is fitted into a female connector portion.
Figure 3:
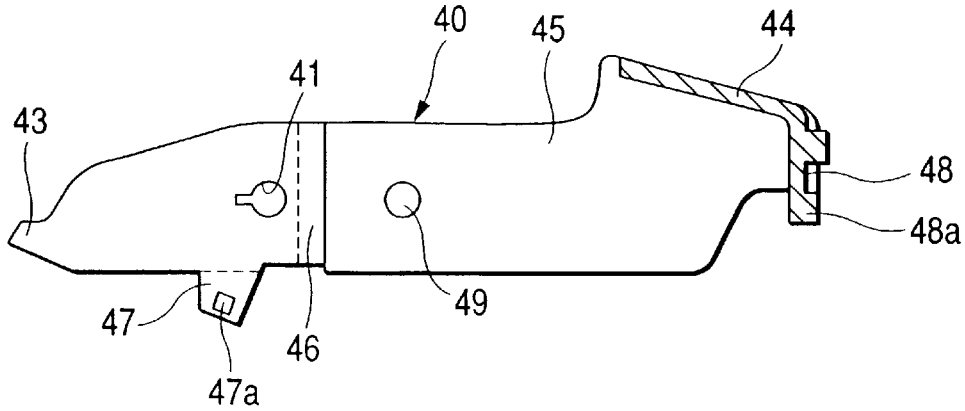
FIG. 3 is a cross-sectional view of an operation lever in the first embodiment.
Figure 6:
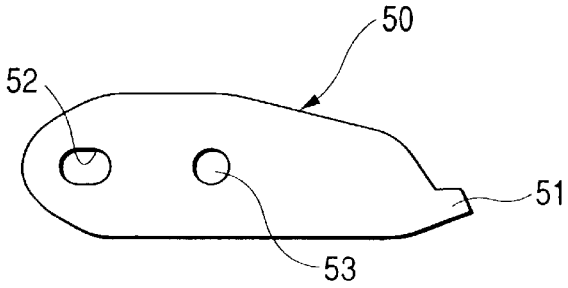
FIG. 6 is a side-elevational view showing a cooperation lever in the first embodiment.

FIG. 1 is an exploded, perspective view of a first embodiment of a lever fitting connector (hereinafter referred to as "connector") 15, FIG. 2 is a cross-sectional view showing a condition before a male connector 30 is fitted into a female connector portion 20, and FIGS. 3 and 6 show an operation lever 40 and a cooperation lever 50, respectively.

As shown in FIG. 1, the connector 15 comprises the female connector 20, having a hood portion 22 formed integrally with a female housing 21. The male connector 30 has a connector body 31 for fitting into the hood portion 22 of the female connector portion 20. The operation lever 40 is fitted on the connector body 31 of the male connector 30 so as to fit the connector body 31 into the hood portion 22 of the female connector portion 20. The cooperation lever 50 is pivotally moved in cooperation with the operation lever 40 so as to fit the connector body 31 into the hood portion 22.

As shown in FIG. 2, in the female connector portion 20, contact portions 23*a* of male terminals 23, housed in the housing portion 21, project into the hood portion 22. Two through holes 25 are formed through each of the opposed walls 24 of the hood portion 22. The outside and inside of the hood portion 22 communicate with each other through these through holes 25. A step portion 22*a* is formed at inner faces 26 of the hood portion 22, and is disposed close to one wall 24. The distance between the inner faces 26, disposed close to the one wall 24, is smaller than the other portions of the inner faces 26 close to the other wall 24, so that a narrow portion 26*a* and a wide portion 26*b* are formed. A lock portion 27 is formed on an upper end of the other wall 24. This lock portion 27 has a lock space 27*a* open to the inside of the hood portion 22. A retaining projection 27*c* is formed on an outer wall 27*b* forming the lock space 27*a*. Thickened portions 28, to be abutted by engaging portions which are described later, are formed on the inner faces 26 of the hood portion 22, and are disposed below the through holes 25, respectively. The connector body 31 of the male connector 30 is fitted into the hood portion 22, and female terminals (not shown), received in the connector body 31, are electrically contacted respectively with the male terminals 23.

Figure 4:
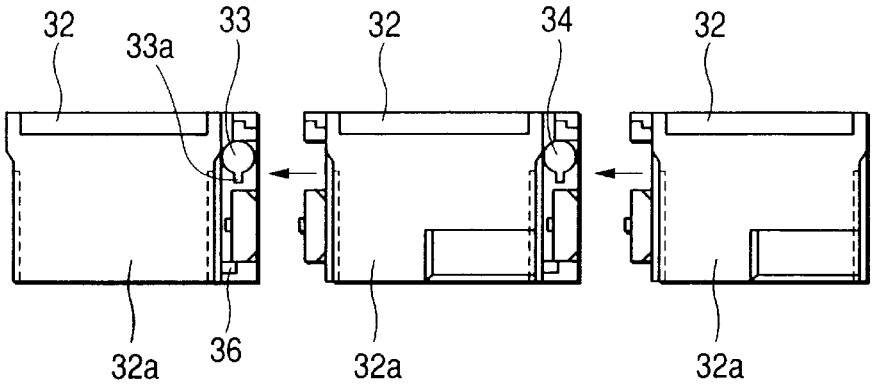
FIG. 4 is a side-elevational view showing connector housings of the male connector in the first embodiment.

As shown in FIG. 4, the male connector 30 comprises the connector body 31 having three connector housings 32 fixedly mounted on each side of a printed board 31*a*, and the female terminals (not shown) received in these connector housings 32. A plurality of terminal receiving chambers 32*a* are formed in the connector housing 32, and the female terminals are received in the terminal receiving chambers 32*a*, respectively. The contact portions 23*a* of the male terminals 23, projecting into the hood portion 22, are inserted respectively into the terminal receiving chambers 32*a* from one ends thereof, and wires W, connected respectively to ends of the female terminals, extend outwardly from the other ends of the terminal receiving chambers.

Moreover, the connector housings 32 are fixedly mounted on each side of the board 31*a* in such a manner that these connector housings are interconnected by recess-projection fitting means. Rotation support shafts 33 and 34, each provided between the adjacent connector housings 32, extend through the board 31*a*. Opposite ends of each of the rotation support shafts 33 and 34 project outwardly beyond outer side faces 32*b* of the connector housings 32, and the length of these shafts 33 and 34 is slightly shorter than the width of the wide portion 26*b* of the hood portion 22. Retaining projections 33*a* are formed on the opposite ends of the rotation support shaft 33, respectively. A provisional fixing protrusion 36 is formed on a lower portion of the outer side face of the connector housing 32. The rotation support shaft 34 is inserted in shaft holes 53 formed respectively in the cooperation levers 50 provided respectively on the opposite sides of the connector body 31. The rotation support shaft 33 is inserted in shaft holes 41 in the operation lever 40, fitted on the connector body 31, so as to allow the pivotal movement of the operation lever 40.

As shown in FIGS. 1 and 3, the operation lever 40 includes a lever body 42 pivotally supported on the connector body 31 of the male connector 30. Engaging projections 43 are formed at one end of the lever body 42, and are retainingly engaged with the hood portion 22 when fitting the connector body 31 into the hood portion 22. An operating portion 44 is formed at the other end of the lever body 42, and causes the lever body 42 to be pivotally moved about portions of the engaging projections 43, retainingly engaged with the hood portion 22, so as to fit the connector body 31 into the hood portion 22. When the connector body 31 is fitted in the hood portion 22, the lever body 42 is received in the hood portion 22.

The lever body 42 comprises a pair of thin plate-like lever walls 45, each are pivotally supported over the side faces 32*b* of the connector housings 32 provided at each side of the connector body 31. The engaging projections 43 are formed respectively at one end of the lever walls 45, and the operating portion 44 interconnects the other end of the pair of lever walls 45. A step portion 46 is formed at each lever wall 45 intermediate the opposite ends thereof, so that the distance between the lever walls 45, disposed close to the engaging projections 43, is reduced. The shaft hole 41 is formed through a portion of each lever wall 45 disposed on one side of the step portion 46 close to the engaging projection 43. The rotation support shaft 33 is inserted in the shaft holes 41, so that each lever wall 45 is pivotally movable over the side faces 32*b* of the connector housings 32.

A provisional fixing arm 47 is formed on and projects from a lower edge of each lever wall 45 at one end portion thereof. A provisional fixing hole 47*a* is formed in the provisional fixing arm 47. The provisional fixing projections 36, formed respectively on the connector housings 32, are retainingly inserted respectively in the provisional fixing holes 47*a*, thereby holding the operation lever 40 in a provisional fixing position relative to the connector body 31. In this condition, the engaging projections 43 are not projected from one end of the connector body 31.

Figure 5:
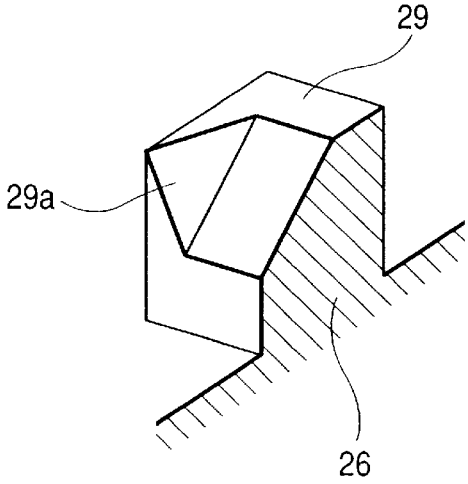
FIG. 5 is a schematic perspective view showing a shape of a release wall.

As shown in FIGS. 1 and 2, a release wall 29 is provided on each inner wall 26 of the hood portion 22. At that position the provisional fixing arm 47 is inserted when the connector body 31 is fitted into the hood portion 22. In each release wall 29, as shown in FIG. 5, there is formed a tapered face 29*a* which slants to the inner wall 26 of the hood portion 22. Function and effect of the release walls 29 will be described later.

A lock arm extends from the operating 44 interconnecting the lever walls 45. A lock projection 48*a* extending outwards is formed on the lock arm 48. The lock arm 48 is inserted into the lock space 27*a* in the hood portion 22. The lock projection 48*a* engages the retaining projection 27*c*, thereby preventing the pivotal movement of the operation lever 40. Connection shafts 49 are formed respectively on opposed faces of the lever walls 45, each disposed on the other side of the step portion 46. The connection shafts 49 are inserted respectively in shaft holes 52 formed respectively through end portions of the cooperation levers 50, so that the cooperation levers 50 are connected to the lever walls 45 so as to be able to pivotally move relative to the lever walls 45.

As shown in FIGS. 1 and 3, the shaft hole 52 is formed through one end portion of the cooperation lever 50, and an engaging projection 51 for retaining engagement with the hood portion 22 is formed on the other end of the cooperation lever 50. The shaft hole 52 is in the form of a slot, and the connection shaft 49 is movable along the length of the shaft hole 52. The shaft hole 53 is formed through the cooperation lever 50 intermediate the opposite ends thereof. The rotation support shaft 34 on the connector body 31 is inserted in the shaft hole 53, and with this arrangement the cooperation lever 50 is pivotally supported on the connector body 31. Hence, the cooperation lever 50 is pivotally connected to the lever wall 45, and also is pivotally supported on the connector body 31.

Therefore, simultaneously when each lever wall 45 is pivotally moved about the portion of the engaging projection 43 retained in the through hole 25, the cooperation lever 50 is pivotally moved about a portion of the engaging projection 51 retained in the through hole 25, and the cooperation lever 50 thus cooperates with the pivotal movement of the lever wall 45. The inner peripheral edges of the shaft holes 41 and 53 press the rotation support shafts 33 and 34, respectively, thereby pressing the connector body 34 into the hood portion 22.

Next, the procedure of fitting the male connector 30 of connector 15 into the female connector portion 20 will be described. The operations of the operation lever 40 and cooperation levers 50 will be described with reference to FIGS. 11(*a*), 11(*b*) and 11(*c*) schematically showing these operations.

Figure 7:
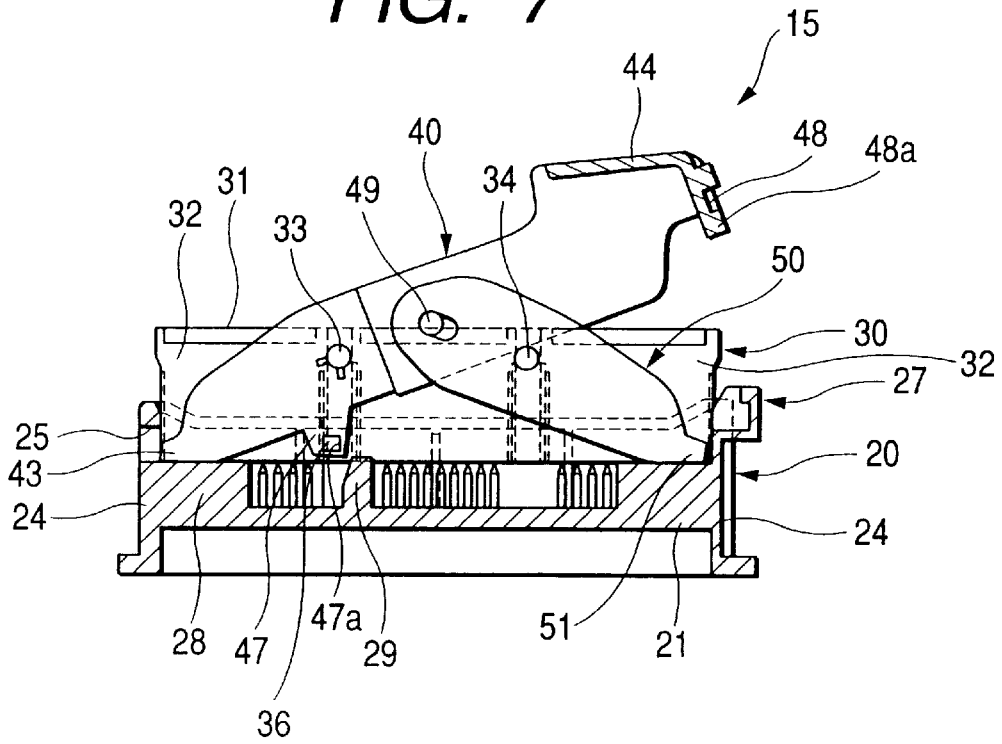
FIG. 7 is a cross-sectional view showing an initial stage of the fitting of a connector body into a hood portion in the first embodiment.

As shown in FIG. 2, the provisional fixing projections 36 are inserted respectively in the provisional fixing holes 47*a* formed respectively in the provisional fixing arms 47, so that the operation lever 40 is held in the provisional fixing position relative to the connector body 31, and the cooperation levers 50 are held in their provisional fixing position. In this condition the fitting side of the connector body 31 is inserted into the hood portion 22. When the fitting side of the connector body 31 is inserted into the hood portion 22, the lower edges of the lever walls 45 of the operation lever 40 and the lower edges of the cooperation levers 50 abut respectively against the upper ends of the thickened portions 28, so that the engaging projections 43 and 51 are in position to be retainingly inserted respectively into the through holes 25, as shown in FIG. 7.

Figure 8:
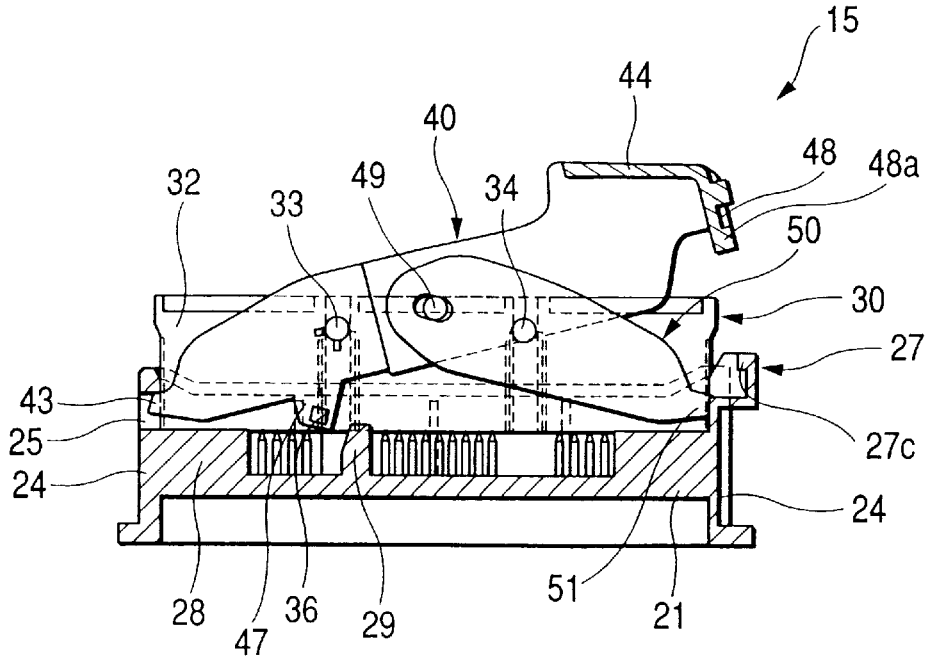
FIG. 8 is a cross-sectional view showing a condition in which the connector body is fitted into the hood portion in the first embodiment, thereby releasing a provisionally-retained condition of the operation lever.

In this condition, when the operation lever 40 is operated to slightly pivotally move the lever walls 45 about the rotation support shaft 33, the engaging projections 43 are inserted into and retained in the respective through holes 25, as shown in FIG. 8. At the same time, the cooperation levers 50 are slightly pivotally moved about the rotation support shaft 34, so that the engaging projections 51 are inserted into and retained in the respective through holes 25. The provisional fixing arms 47 abut respectively against the tapered faces 29*a* of the release walls 29, and are flexed outwardly, that is, toward the inner face of the hood portion 22, so that the provisional fixing projections 36 are withdrawn respectively from the retaining holes 47*a*. As a result, the holding of the operation lever 40 in the provisional fixing position relative to the connector body 31 is released.

Figure 9:
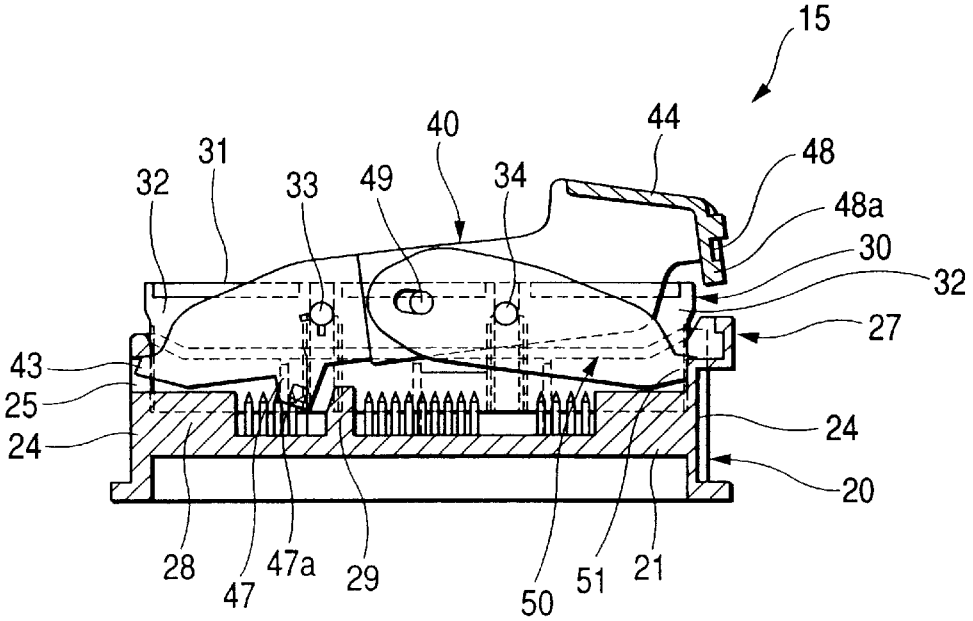
FIG. 9 is a cross-sectional view showing a condition in which the connector body is in the process of being fitting into the hood portion in the first embodiment.
Figure 10:
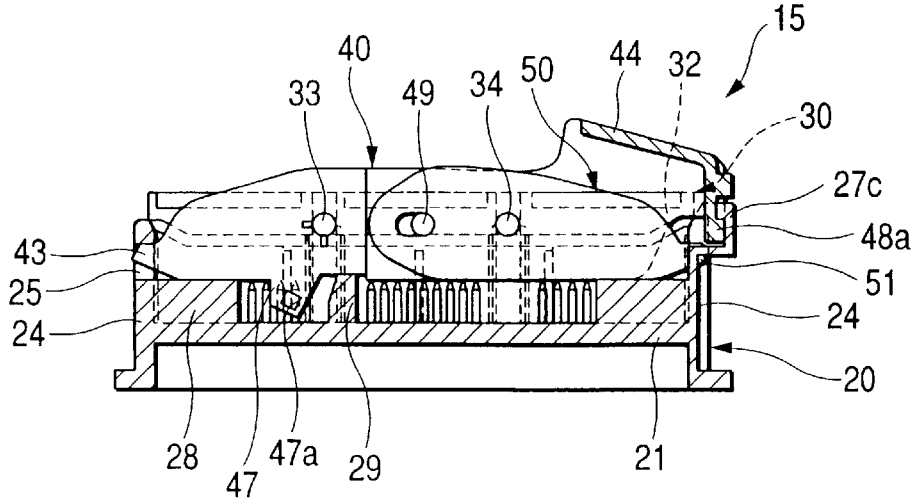
FIG. 10 is a cross-sectional view showing a condition in which the connector body is completely fitted in the hood portion in the first embodiment.

Then, as shown in FIG. 9, when the operation lever 40 is further pivotally moved, each lever wall 45 is pivotally moved about the portion of the engaging projection 43 retained in the through hole 25, thereby further moving the connector body 31 into the hood portion 22 through the rotation support shaft 33. At the same time, each cooperation lever 50 is pivotally moved about the portion of the engaging projection 51 retained in the through hole 25, thereby further moving the connector body 31 into the hood portion 22. As a result, the connector body 31 is completely fitted into the hood portion 22 through the pivotal movement of the lever walls 45 and cooperation levers 50, as shown in FIG. 10.

Figure 11A:
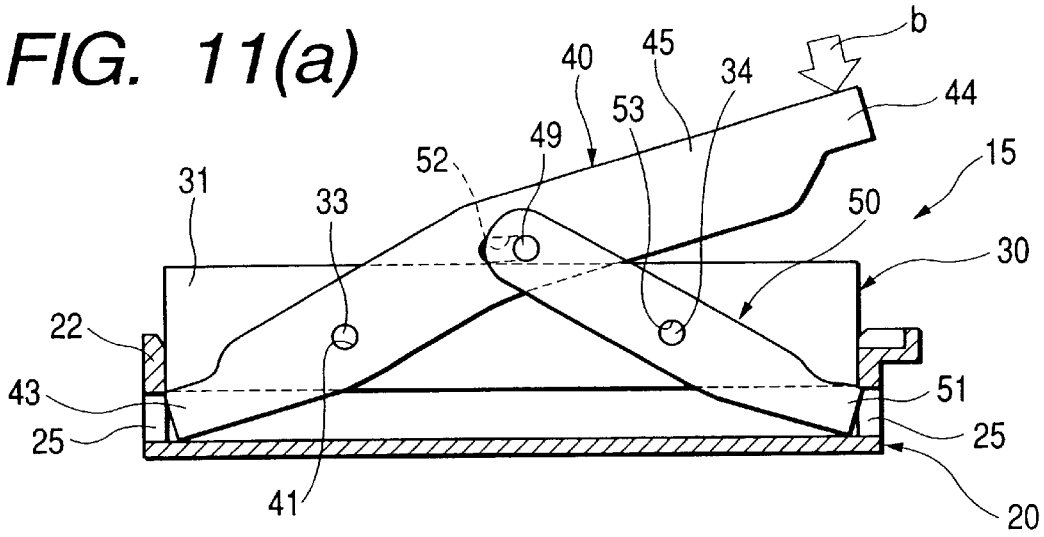
FIG. 11 schematically shows the operation of the operation lever and cooperation levers in the first embodiment, FIG. 11(*a*) being a cross-sectional view showing a condition in which the provisionally-retained condition of the operation lever and cooperation levers is released, FIG. 11(*b*) being a cross-sectional view showing a condition in which the operation lever and the cooperation levers are in the process of pivotal movement, and FIG. 11(*c*) being a cross-sectional view showing the operation lever and the cooperation levers when the connector body is fitted in the hood portion.
Figure 11B:
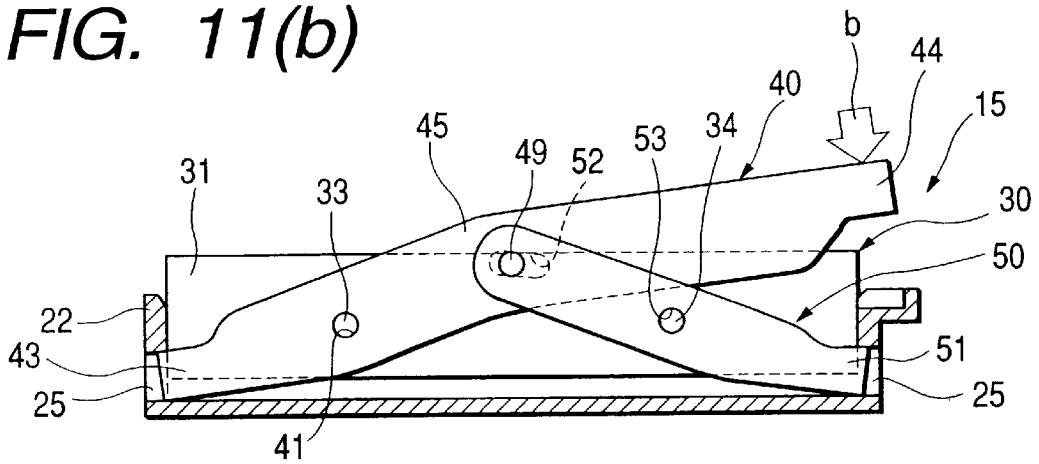
Figure 11C:
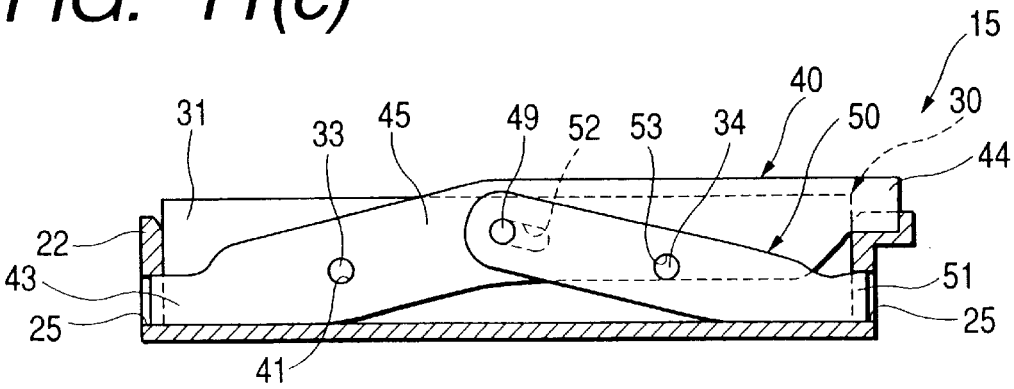

Next, the relation between the operation lever 40 and the cooperation levers 50 during the above fitting operation will be described with reference to FIG. 11 showing a schematic view. When the operation lever 40 is held in the provisional fixing position relative to the connector body 31 as shown in FIG. 11(*a*), the cooperation levers 50 are also held in the provisional fixing position relative to the connector body 31. In this schematic view, a connection shaft 49 is formed on one side of the cooperation lever 50 while a shaft hole 52 is formed in the operation lever 40.

In this condition, when the operation lever 40 is pressed in a direction of arrow B, the operation lever 40 is pivotally moved about the portion of the engaging projection 43 retained in the through hole 25.

When the operation lever 40 is pivotally moved as shown in FIG. 11(*b*), the connection shaft 49 is also pivotally moved, and is moved along the shaft hole 52. As a result, one end portion of the cooperation lever 50 is pivotally moved. At this time, the cooperation lever 50 is pivotally moved about the portion of the engaging projection 51 retained in the through hole 25 as a fulcrum. When the operation lever 40 is pivotally moved, the operation lever 40 presses the connector body 31 toward the hood portion 22, with the rotation shaft 33 serving as a point of action. When the cooperation lever 50 is pivotally moved, the cooperation lever 50 presses the connector body 31 toward the hood portion 22, with the rotation shaft 34 serving as a point of action. As a result, the connector body 31 is inserted and fitted into the hood portion 22 through the leverage of the operation lever 40 and cooperation levers 50, as shown in FIG. 11(*c*).

In this embodiment, the connector body 31 is pressed toward the hood portion 22 through two support portions, that is, the support portion at which the lever walls 45 are pivotally supported on the connector body 31, and the support portion at which the cooperation levers 50 are pivotally supported on the connector body 31. Therefore, even if the connector body 31 has a large length, the connector body 31 can be pressed generally uniformly over its entire length, and therefore the connector body 31 can be smoothly inserted into the hood portion 22 without tilting.

Since the connector body 31 can be smoothly inserted into the hood portion 22 without tilting, the fitting force will not increase, and the operating force (required for pivotally moving the operation lever 40) will not increase.

In this embodiment, the portion where the lever wall 45 of the operation lever 40 and the cooperation lever 50 are connected together is disposed between the support portion where the lever wall 45 is supported on the connector body 31 and the support portion where the cooperation lever 50 is supported on the connector body 31. More specifically, the connection shaft 49 is disposed between the rotation support shafts 33 and 34. Therefore, the connector body 31 can be pressed generally uniformly toward the hood portion 22. and can be easily inserted into the hood portion 22 without tilting.

The shaft hole 52, receiving the connection shaft 49, is formed into a slot, and therefore the connection shaft 49 is moved along the shaft hole 52, so that the cooperation lever 50 can be pivotally moved with almost no resistance from the operation lever 40.

In this embodiment, before the connector body 31 is fitted into the hood portion 22, the operation lever 40 is held in the provisional fixing position by the provisional fixing members, and the engaging projections 43 of the lever walls 45 and the engaging projections 51 of the cooperation levers 50 are not projected outwardly from the ends of the connector body 31. Therefore when the fitting side of the connector body 31 is to be inserted into the hood portion 22, the engaging projections 43 of the lever walls 45 and the engaging projections 51 of the cooperating walls 50 will not be caught by the hood portion 22, and hence will not prevent the inserting operation.

In this embodiment, the operation lever 40 is held in the provisional fixing position relative to the connector body 31. In this condition the fitting side of the connector body 31 is inserted into the hood portion, and the lower edges of the lever walls 45 and cooperation levers 50 are abutted respectively against the upper ends of the thickened portions 28. When the lever walls 45 and the cooperation levers 50 are pivotally moved, the engaging projections 43 and 51 can be easily engaged in the through holes 25, respectively. This enhances the efficiency of the fitting operation in which the connector body 31 is fitted into the hood portion 22.

In this embodiment, the operation lever 40 is fitted on the connector body 31, and the operation lever 40 is disposed inside the hood portion 22, and the cooperation levers 50 are disposed inside the operation lever 40. That is, each cooperation lever 50 is disposed between the lever wall 45 and the outer faces 32*b* of the connector housings 32 of the connector body 31, and therefore the rotation support shafts 33 and 34 will not be disengaged from the shaft holes 41 and 53 as a result of flexing of the lever walls 45 and cooperation levers 50.

Other embodiments will be describe below. Those portions identical to those of the above first embodiment will be designated by identical reference numerals, respectively, and explanation thereof will be omitted.

Second Embodiment

A second embodiment of a lever fitting connector 55, shown in FIG. 12, will be described below. In the above first embodiment, one pair of cooperation levers 50 is provided, and there are provided the two support portions (each serving as the point of action), that is, the support portion at which the lever walls 45 are pivotally supported on the connector body 31, and the support portion at which the cooperation levers 50 are pivotally supported on the connector body 31. On the other hand, in the second embodiment, in addition to cooperation levers 50, cooperation levers 60 are provided which are parallel to and longer than the cooperation levers 50.

Figure 12A:
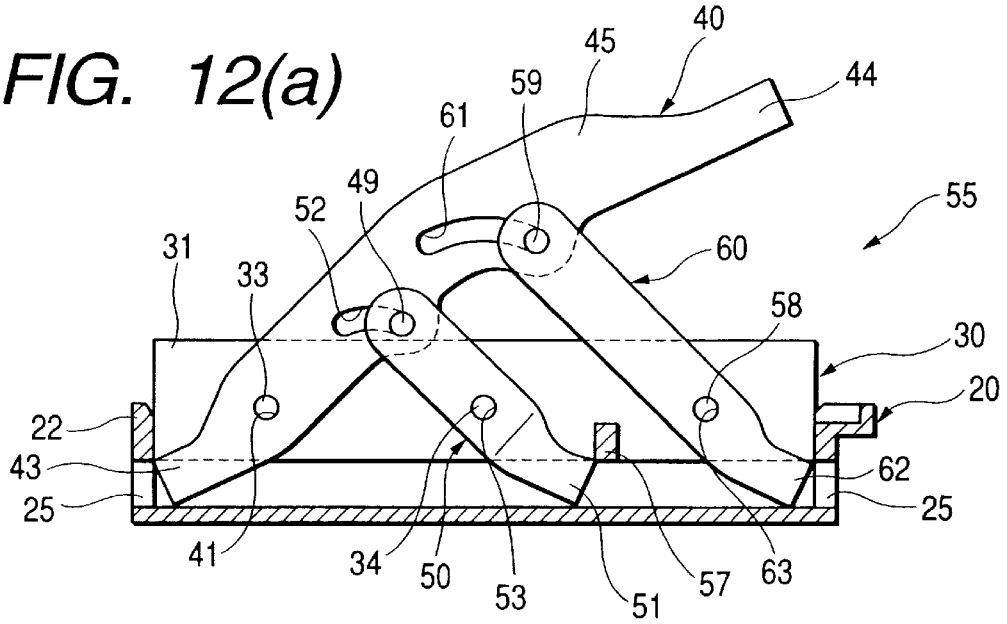
FIG. 12 schematically shows the operation of an operation lever and cooperation levers in a second embodiment, FIG. 12(*a*) being a cross-sectional view showing a condition in which the provisionally-retained condition of the operation lever and cooperation levers is released, FIG. 12(*b*) being a cross-sectional view showing a condition in which the operation lever and the cooperation levers are in the process of pivotal movement, and FIG. 12(*c*) being a cross-sectional view showing the operation lever and the cooperation levers when a connector body is fitted in a hood portion.
Figure 12B:
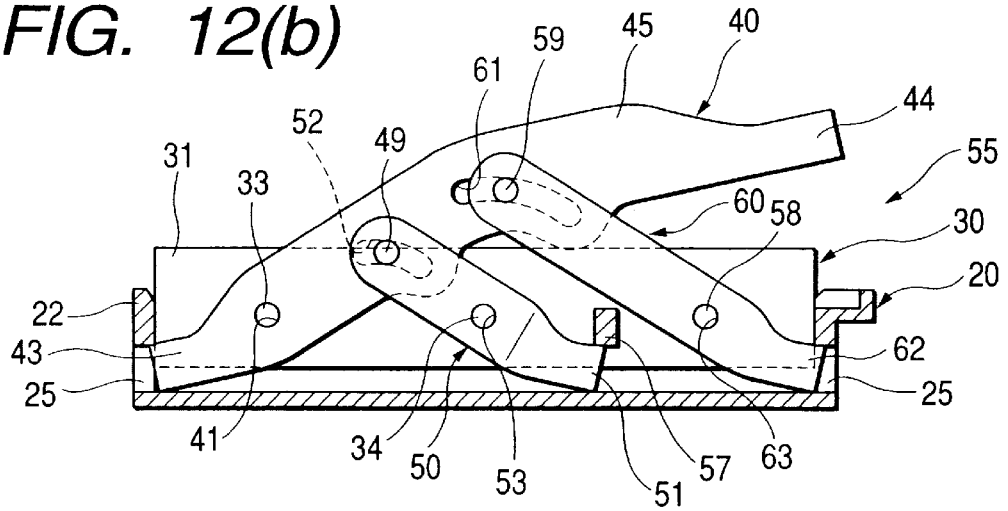
Figure 12C:
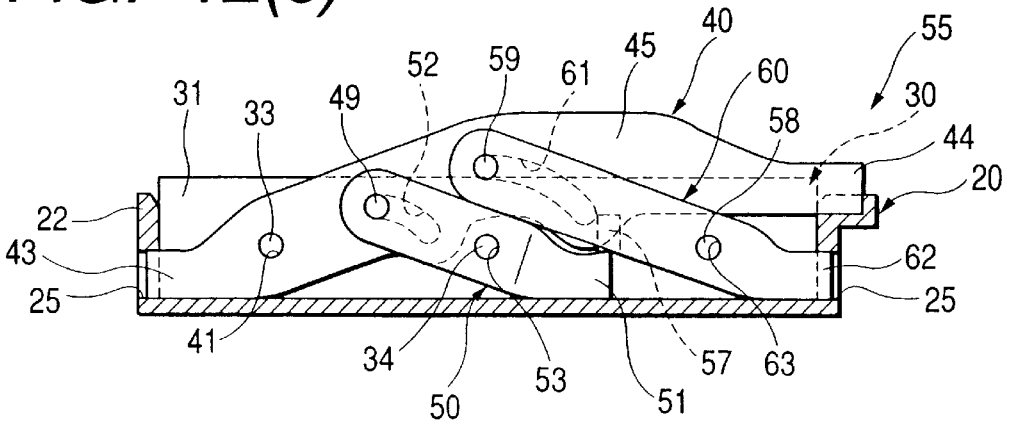

As shown in FIG. 12(*a*), the cooperation levers 60, longer than the cooperation levers 50, are provided above the cooperation levers 50 in generally parallel relation thereto. A connection shaft 59 is formed at one end portion of the cooperation lever 60, and a engaging projection 62 for retaining engagement in a through hole 25 in a hood portion 22 is formed at the other end of the cooperation lever 60. The connection shaft 59 is received in a shaft hole 61 (in the form of an slot) formed in a lever wall 45, so that the cooperation lever 60 is pivotally connected to an operation lever 40. A shaft hole 63 is formed in a portion of the cooperation lever 60 disposed between the engaging projection 62 and the shaft hole 61. A rotation support shaft 58, formed on a connector body 31, is inserted in the shaft hole 63, so that the cooperation lever 60 is pivotally supported on the connector body 31.

In this embodiment, an engaging projection 51 of the cooperation lever 50 is retainingly engaged with an engagement or intermediate wall 57 formed on an inner face of the hood portion 22.

The operation lever 40 is held in a provisional fixing position relative to the connector body 31, and in this condition the fitting side of the connector body 31 is inserted into the hood portion 22 as shown in FIG. 12(*a*). The operation lever 40 is then operated to pivotally move the lever walls 45 about a rotation support shaft 33, so that engaging projections 43 of the lever walls 45 are retainingly engaged in the through holes 25, respectively. At the same time, each cooperation lever 50 is pivotally moved about a rotation support shaft 34, so that the engaging projection 51 is retainingly engaged with the engagement or intermediate wall 57. Each cooperation lever 60 is also pivotally moved about the rotation support shaft 58, so that the engaging projection 62 is retainingly engaged in the through hole 25.

When the operation lever 40 is further operated, each lever wall 45 is pivotally moved about a portion of the engaging projection 43 retained in the through hole 25, thereby pressing the connector body 31 toward the hood portion 22. At the same time each cooperation lever 50 is pivotally moved about a portion of the engaging projection 51 retainingly engaged with the engagement or intermediate wall 57, thereby pressing the connector body 31 toward the hood portion 22. Also, each cooperation lever 60 is pivotally moved about a portion of the engaging projection 62 retained in the through hole 25, thereby pressing the connector body 31 toward the hood portion 22.

As a result, the connector body 31 is completely inserted and fitted into the hood portion 22 as shown in FIG. 12(*c*).

In this embodiment, there is provided one operation lever 40 and two pairs of cooperation levers 50 and 60. In addition, there are three support portions at which the levers press the connector body 31. Thus, even if the connector body 31 has a longer length, the connector body 31 can be pressed generally uniformly relative to the hood portion 22, and therefore the connector body 31 can be inserted into the hood portion 22 without tilting.

In this embodiment, the fitting force, required for fitting the 15 connector body 31 into the hood portion 22 is distributed to three portions, that is, the rotation support shafts 33, 34 and 58. Therefore the load acting on each of the rotation support shafts 33, 34 and 58, is reduced, and the burden on the rotation support shafts 33, 34 and 58 is reduced. As a result, damage to the rotation support shafts 33, 34 and 58 can be positively prevented.

Third Embodiment

Next, a third embodiment of a lever fitting connector 65, shown in FIG. 13, will be described. In this embodiment, at least one of a support portion, at which lever walls 45 of an operation lever 40 are supported on a connector body 31 when inserting the connector body 31 into a hood portion 22, and a support portion, at which cooperation levers 50 are supported on the connector body 31, is disposed at a portion of the connector body 31 where a larger fitting resistance is encountered when fitting the connector body 31 into the hood portion 22.

Figure 13A:
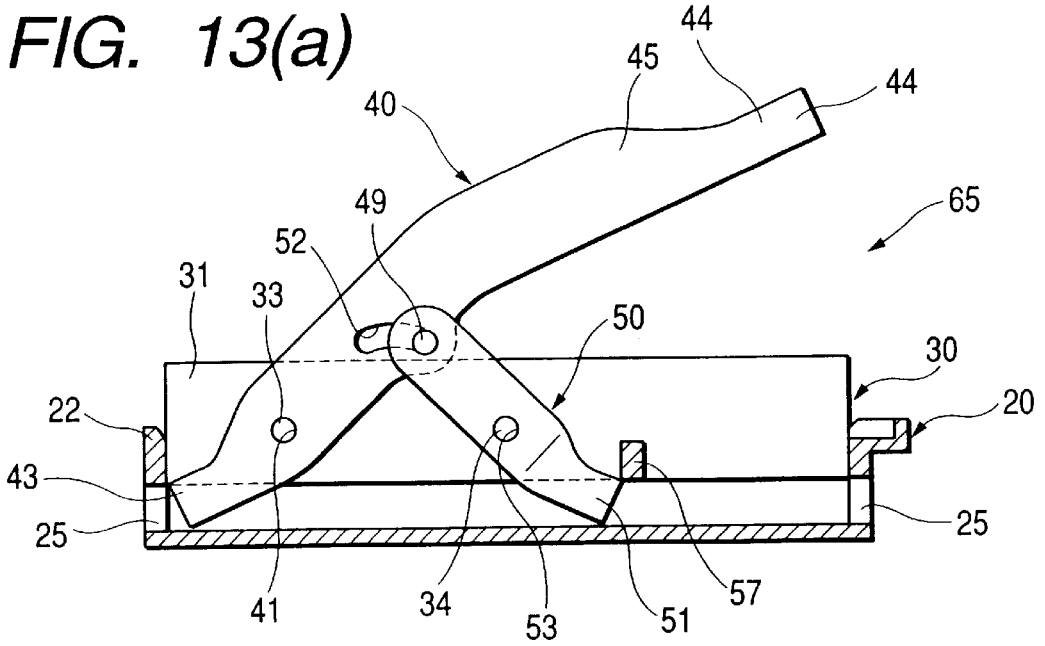
FIG. 13 schematically shows the operation of an operation lever and cooperation levers in a third embodiment, FIG. 13(*a*) being a cross-sectional view showing a condition in which the provisionally-retained condition of the operation lever and cooperation levers is released, FIG. 13(*b*) being a cross-sectional view showing a condition in which the operation lever and the cooperation levers are in the process of pivotal movement, and FIG. 13(*c*) being a cross-sectional view showing the operation lever and the cooperation levers when a connector body is fitted in a hood portion.
Figure 13B:
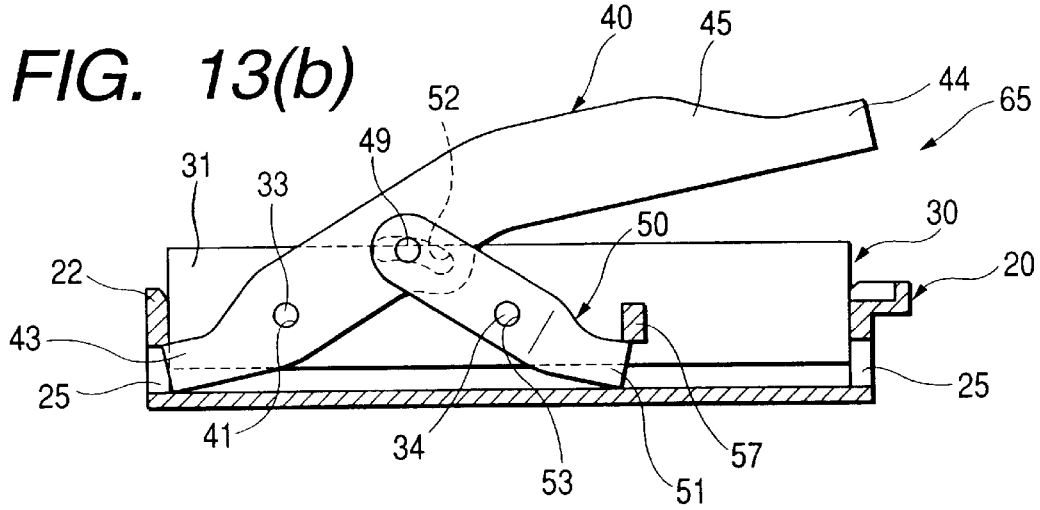
Figure 13C:
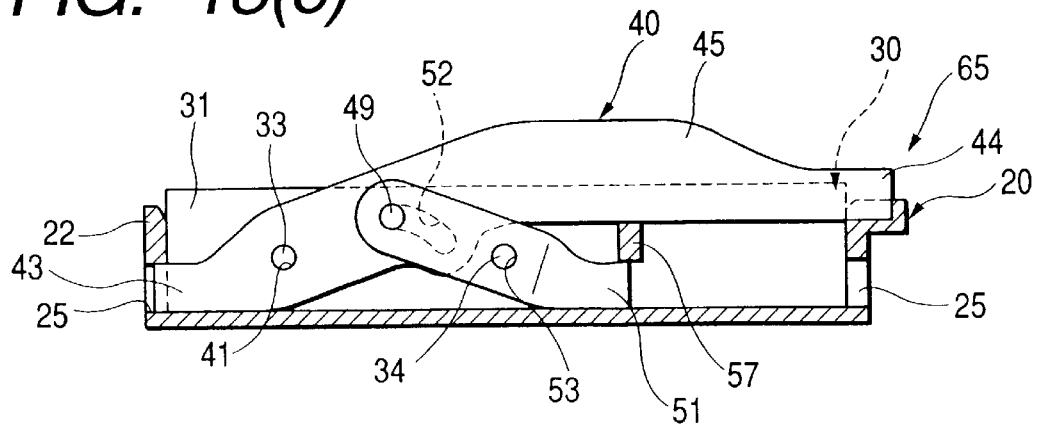

As shown in FIG. 13(*a*), the lever walls 45 of the operation lever 40 are pivotally connected to a rotation support shaft 33 (formed on the connector body 31) which is disposed at a position close to one end of the connector body 31. In addition, the cooperation levers 50 are pivotally connected to a rotation support shaft 34 (formed on the connector body 31) which is disposed at a position offset toward one end of the connector body 31. An engaging projection 51 of the cooperation lever 50 is able to engage with an engagement or intermediate wall 57 formed on the hood portion 22.

Namely, in the lever fitting connector 65 shown in FIGS. 13(*a*), 13(*b*) and 13(*c*), the fitting resistance, developing when fitting the connector body 31 into the hood portion 22, is larger at the left side portion than at the right side portion in FIG. 13.

In this lever fitting connector 65, the support portion (that is, the rotation support shaft 33 and shaft holes 41), at which the lever walls 45 are pivotally supported on the connector body 31, and the support portion (that is, the rotation support shaft 34 and shaft holes 53), at which the cooperation levers 50 are pivotally supported on the connector body 31, are disposed at the left side portion in FIG. 13 where the larger fitting resistance is encountered. Therefore, through the leverage of the lever walls 45 and cooperation levers 50, the connector body 31 can be easily inserted into the hood portion 22 without tilting.

Fourth Embodiment

Next, a fourth embodiment of a lever fitting connector 75, shown in FIG. 14, will be described. In this embodiment, a connection portion, at which lever walls 85 of an operation lever 80 are connected to cooperation levers 90, is not disposed between a support portion at which the lever walls 85 are pivotally supported on a connector body 31 and a support portion at which the cooperation levers 90 are pivotally supported on the connector body 31.

Figure 14A:
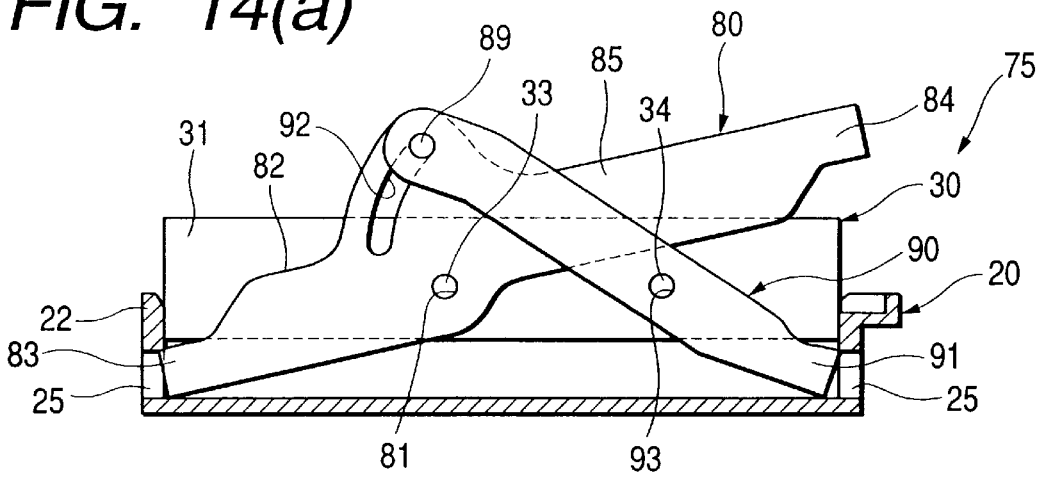
FIG. 14 schematically shows the operation of an operation lever and cooperation levers in a fourth embodiment, FIG. 14(*a*) being a cross-sectional view showing a condition in which the provisionally-retained condition of the operation lever and cooperation levers is released, FIG. 14(*b*) being a cross-sectional view showing a condition in which the operation lever and the cooperation levers are in the process of pivotal movement, and FIG. 14(*c*) being a cross-sectional view showing the operation lever and the cooperation levers when a connector body is fitted in a hood portion.
Figure 14B:
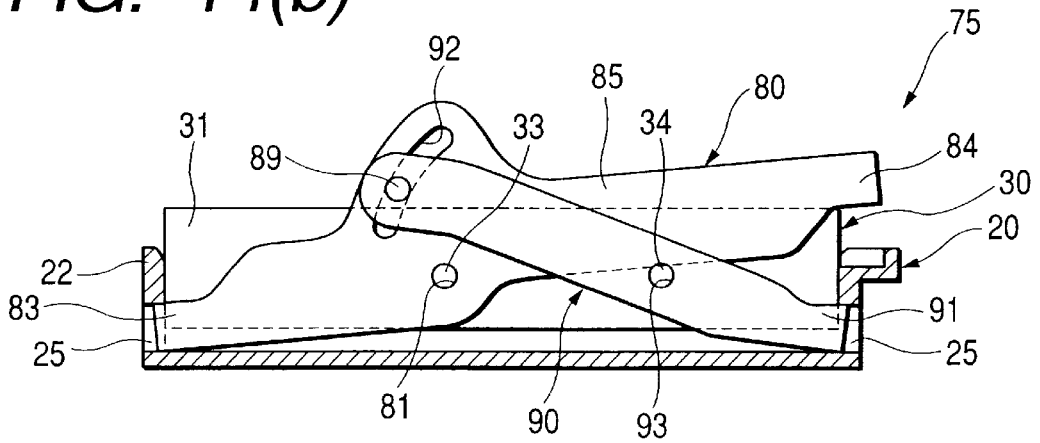
Figure 14C:
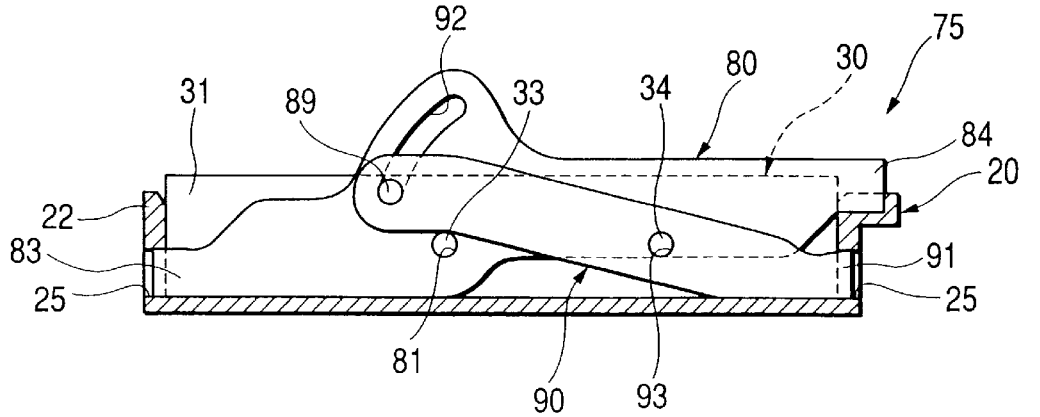
Figure 15:
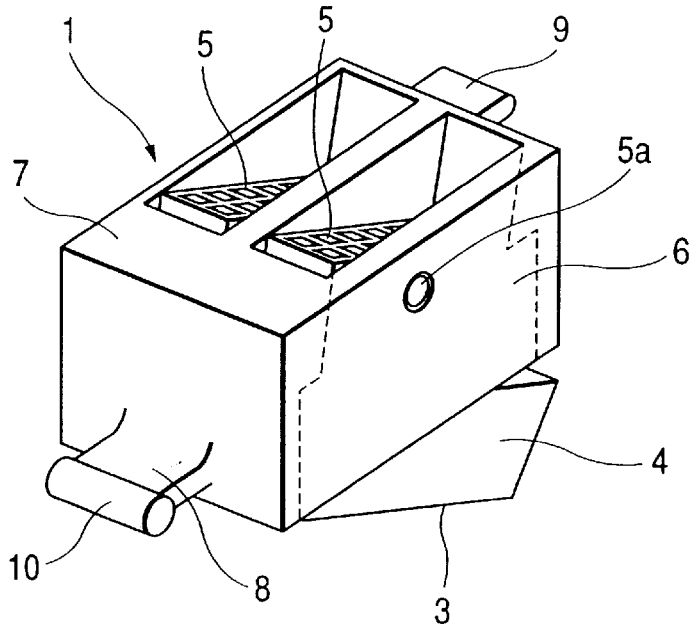
FIG. 15 PRIOR ART
FIG. 15 is a perspective view of a conventional frame connecting connector.
Figure 16:
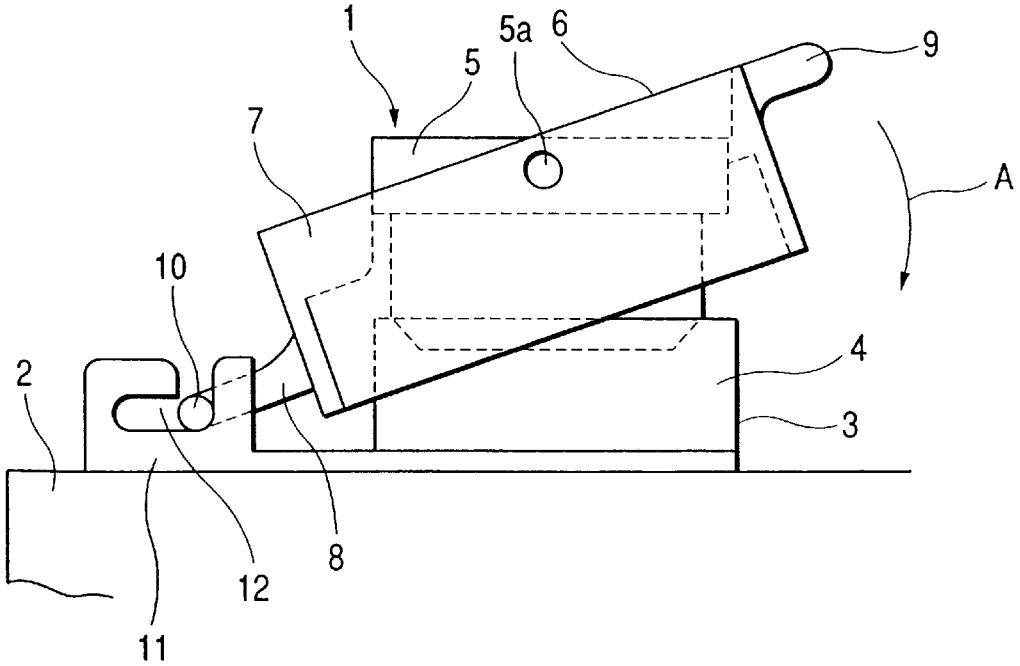
FIG. 16 PRIOR ART
FIG. 16 is a side-elevational view showing the operation of the conventional frame connecting connector.

As shown in FIG. 14(*a*), the lever fitting connector 75 of this embodiment comprises the operation lever 80, and the cooperation lever 90 pivotally connected to the operation lever 80. Like the operation lever 40 of the first embodiment, the operation lever 80 has shaft holes 81, engaging projections 83, and the lever walls 85. A rotation support shaft 33, formed on the connector body 31, is inserted in the shaft holes 81, so that the operation lever 80 is pivotally supported. A shaft hole 92 in the form of an slot is formed in each lever wall 85.

Like the cooperation lever 50 of the first embodiment, the cooperation lever 90 has an engaging projection 91 and a shaft hole 93. A rotation support shaft 34, formed on the connector body 31, is inserted in the shaft hole 93, so that the cooperation lever 90 is pivotally supported. A connection shaft 89 is formed on the cooperation lever 90. The connection shaft 89 is received in the shaft hole 92, and is movable therealong. With this construction, the lever walls 85 and the cooperation levers 90 are pivotally connected together.

In the lever fitting connector 75 of this embodiment, the connection shafts 89 are inserted respectively in the shaft holes 92 at a position disposed outside of a space defined as being between a support portion at which the lever walls 85 are pivotally supported on the connector body 31 and a support portion at which the cooperation levers 90 are pivotally supported on the connector body 31, that is, at a position which is outside of the space defined as being between the rotation support shafts 33 and 34.

The operation lever 80 is disposed at a provisional fixing position, and the cooperation levers 90 are disposed at their provisional fixing position, and in this condition the fitting side of the connector body 31 is inserted into a hood portion 22, as shown in FIG. 14(*a*). Then, when the operation lever 80 is operated to pivotally move the lever walls 85, the engaging projections 83 are inserted and retained in the through holes 25, respectively, and the engaging projections 91 of the cooperation levers 90 are inserted and retained in the through holes 25, respectively. When the operation lever 80 is further operated as shown in FIG. 14(*b*), each lever wall 85 is pivotally moved about a portion of the engaging projection 83 retained in the through hole 25, thereby pressing the connector body 31 deeper into the hood portion 22 through the rotation support shaft 33. At the same time, each cooperation lever 90 is pivotally moved about a portion of the engaging projection 91 retained in the through hole 25, thereby pressing the connector body 31 deeper into the hood portion 22 through the rotation support shaft 34. At this time, the lever walls 85 and the cooperation levers 90 are connected together at a position which is outside of the space defined as being between the rotation support shafts 33 and 34, and each connecting shaft 89 moves along the shaft hole 92.

In this embodiment, effects similar to those of the above embodiments can be obtained. When it is desired to locate a support portion (that is, the rotation support shaft 33 and the shaft holes 81), at which the operation lever 80 is pivotally supported on the connector body 31, and a support portion (that is, the rotation support shaft 34 and the shaft holes 93), at which the cooperation levers 90 are pivotally supported on the connector body 31, where the fitting resistance, developing when fitting the connector body 31 into the hood portion 22, is larger, the lever walls 85 and the cooperation levers 90 can be pivotally connected together at a position which is outside of the space defined as being between the support portions. Therefore, the support portions can be set at desired positions, and the degree of freedom of the design is improved.

According to the present invention, through the two support portions, that is, the support portion, at which the lever body is pivotally supported on the connector body, and the support portion at which the cooperation lever is pivotally supported on the connector body, the connector body is pressed into the hood portion, and therefore even if the connector body has long length, the connector body can be smoothly inserted into the hood portion without tilting.

Since the connector body can be inserted into the hood portion without tilting, the fitting force will not increase, and the operating force will not increase.

According to the present invention, not only through the support portion, at which the lever body is pivotally supported on the connector body, but also through the support portions at which the plurality of cooperation levers are pivotally supported on the connector body, respectively, the connector body is pressed into the hood portion, and therefore even if the connector has long length, the connector body can be inserted into the- hood portion without tilting.

According to the present invention, at least one of the support portions, at which the lever body is pivotally supported on the connector body, and the support portion, at which the cooperation lever is pivotally supported on the connector body, is disposed at the portion of the connector body at which a larger fitting resistance is encountered. With this construction the connector body can be efficiently pressed into the hood portion through the leverage of the operation lever and cooperation lever, and the connector body can be inserted into the hood portion without tilting.

According to the present invention, the connection portion, at which the lever body of the operation lever and the cooperation lever are connected together, is disposed between the support portion, at which the lever body is supported on the connector body, and the support portion at which the cooperation lever is supported on the connector body, and therefore the connector body can be pressed into the hood portion uniformly through the support portions.

The connection portion, at which the lever body of the operation lever and the cooperation lever are connected together, may be disposed at a position which is outside of the space defined as being between the support portion at which the lever body is supported on the connector body and the support portion at which the cooperation lever is supported on the connector body. In this manner, for example, one support portion can be disposed at the portion of the connector body at which a larger fitting resistance is encountered, and another support portion can be provided at the portion where a larger fitting resistance is encountered.

According to the present invention, the connection shaft, formed on the lever body, moves along the slot in the cooperation lever, so that the cooperation lever can be pivotally moved with almost no resistance in cooperation with the pivotal movement of the lever body.

According to the present invention, the engaging projections of the lever body and cooperation lever do not project from the side faces of the connector body, and therefore when the fitting side of the connector body is to be inserted into the hood portion, the engaging projections of the lever body and cooperation lever will not prevent the fitting operation.

According to the present invention, the lever body and the cooperation lever are held in their respective provisional fixing positions by the provisional fixing members, and in this condition the connector body is inserted into the hood portion, and when the operation lever is operated, the lever body and the cooperation lever are simultaneously pivotally moved respectively about those portions of the projections of the lever body and cooperation lever retained on the hood portion, thereby inserting the connector body deeper into the hood portion. Therefore, the operability is enhanced.

What is claimed is:

1. A lever fitting connector comprising:

a female connector having a hood-like outer peripheral wall;

a male connector fitted into the female connector;

an operation lever body pivotally supported on an outer face of a side wall of the male connector, the operation lever body being adapted to fit within the hood-like outer peripheral wall of the female connector;

an engaging projection, provided at one end of the operation lever body, for engaging with the hood-like outer peripheral wall of the female connector;

an operation portion provided at the other end of the operation lever body; and a cooperation lever pivotally supported on the outer face of the side wall of the male connector, one end of the cooperation lever being connected with the operation lever body to form a connection portion, and the other end of the cooperation lever having an engaging projection, wherein the operation lever body is pivotally moved about a portion where the engaging projection of the operation lever body is engaged with the outer peripheral wall of the female connector and the cooperation lever is pivotally moved about a portion where the engaging projection of the cooperation lever is engaged with the outer peripheral wall of the female connector, so that the male connector is fitted into the female connector.

2. The lever fitting connector as set forth in claim 1, wherein the female connector further includes at least one intermediate wall in the outer peripheral wall, the cooperation lever includes a plurality of cooperation lever bodies, one end of each cooperation body is connected with the operation lever body, each cooperation body has an engaging projection at the other end thereof, one of the engaging projections provided on the plurality of cooperation lever bodies is engaged with the outer peripheral wall of the female connector, the others of the engaging projections of the plurality of cooperation levers are engaged with the intermediate wall of the female connector.

3. The lever fitting connector as set forth in claim 1, further comprising a plurality of fitting resistances formed between a body of the male connector and a hood portion of the female connector;

wherein the plurality of fitting resistances include a first and second fitting resistance which are larger than the other fitting resistances; and wherein at least one support portion for supporting the operation lever body on the male connector, is disposed at a portion of the male connector at which one of the first and second fitting resistances is formed, and at least one support portion for supporting the cooperation lever on the male connector, is disposed at a portion of the male connector at which the other of the first and second fitting resistance is formed, when the male connector is being fitted into the female connector.

4. The lever fitting connector as set forth in claim 1, wherein the connection portion of the cooperation lever with the operation lever body is located between a support portion at which the operation lever body is supported on the male connector and a support portion at which the cooperation lever is supported on the male connector.

5. The lever fitting connector as set forth in claim 1, wherein the connection portion of the cooperation lever with the operation lever is positioned outside of an area formed between a support portion at which the operation lever body is supported on the male connector and a support portion at which the cooperation lever is supported on the male connector.

6. The lever fitting connector as set forth in claim 1 further including:

provisional fixing members for provisionally fixing the operation lever in a position so that the engaging projections of the operation lever body and the engaging projection of the cooperation lever do not project from the male connector.

7. The lever fitting connector as set forth in claim 6, wherein the provisional fixing members include a provisional fixing arm projecting from the operation lever body and having a retaining hole therein, a provisional fixing projection formed on the male connector and releasably engaging with the retaining hole to provisionally retain the operation lever body in the provisional fixing position, and a releast projection formed on an inner face of the outer peripheral wall of the female connector, wherein flexing of the provisional fixing arm caused by pivotal movement of the operation lever body releases the retaining engagement of the provisional fixing projection in the retaining hole.

8. The lever fitting connector as set forth in claim 1, wherein the connection portion of the operation lever body and the cooperation lever includes a connection shaft projecting from one of the operation lever body and the cooperation lever, and a slot formed in the other and supporting the connection shaft so as to be movable along the slot.

9. The lever fitting connector as set forth in claim 2, wherein the connection portion of the operation lever body and the cooperation lever includes a connection shaft projecting from one of the operation lever body and the cooperation lever, and a slot formed in the other and supporting the connection shaft so as to be movable along the slot.

10. The lever fitting connector as set forth in claim 3, wherein the connection portion of the operation lever body and the cooperation lever includes a connection shaft projecting from one of the operation lever body and the cooperation lever, and a slot formed in the other and supporting the connection shaft so as to be movable along the slot.

11. The lever fitting connector as set forth in claim 4, wherein the connection portion of the operation lever body and the cooperation lever includes a connection shaft projecting from one of the operation lever body and the cooperation lever, and a slot formed in the other and supporting the connection shaft so as to be movable along the slot.

12. The lever fitting connector as set forth in claim 5, wherein the connection portion of the operation lever body and the cooperation lever includes a connection shaft projecting from one of the operation lever body and the cooperation lever, and a slot formed in the other and supporting the connection shaft so as to be movable along the slot.

13. A fitting connector comprising:

a female connector having a hood-like outer peripheral wall;

a make connector fitted into the female connector;

an operation lever body pivotally supported on an outer face of a side wall of the male connector;

an engaging projection, provided at one end of the operation lever body, for engaging with the hood-like outer peripheral wall of the female connector;

an operation portion provided at the other end of the operation lever body;

a cooperation lever pivotally supported on the outer face of the side wall of the male connector, one end of the cooperation lever being connected with the operation lever body, and the cooperation lever having an engaging projection at the other end thereof, wherein the operation lever body is pivotally moved about a portion where the engaging projection of the operation lever is engaged with the outer peripheral wall of the female connector, and the cooperation lever is pivotally moved about a portion where the engaging projection of the cooperation lever is engaged with the outer peripheral wall of the female connector, so that the male connector is fitted into the female connector; and a provisional fixing member for provisionally fixing the operation lever body in a position so that the engaging projection of the operation lever body and the engaging projection of the cooperation lever do not project from the male connector, wherein the provisional fixing member includes a provisional fixing arm projecting from the operation lever body and having a retaining hole therein, a provisional fixing projection formed on the male connector and releasably engaging with the retaining hole to provisionally retain the operation lever body in the provisional fixing position, and a release projection formed on an inner face of the outer peripheral wall of the female connector, whereby the pivotal movement of the operation lever body flexes the provisional fixing arm and thereby releases the retaining engagement of the provisional fixing projection in the retaining hole when the male connector is fitted into the female connector.

14. A lever fitting connector comprising:

a female connector having a hood-like outer peripheral wall;

a male connector fitted into the female connector;

an operation lever body pivotally supported on an outer face of a side wall of the male connector;

an engaging projection, provided at one end of the operation lever body, for engaging with the hood-like outer peripheral wall of the female connector;

an operation portion provided at the other end of the operation lever body;

a cooperation lever pivotally supported on the outer face of the side wall of the male connector, one end of the cooperation lever being connected with the operation lever body forming a connection portion, the connection portion having a connection shaft projecting from one of the operation lever body and the cooperation lever, and a slot formed in the other one of the operation lever body and the cooperation lever to support the connection shaft so as to be movable along the slot; and wherein the operation lever body is pivotally moved about a portion where the engaging projection of the operation lever body is engaged with the outer peripheral wall of the female connector, and the cooperation lever is pivotally moved about a portion where the engaging projection of the cooperation lever is engaged with the outer peripheral wall of the female connector, so that the male connector is fitted into the female connector.

* * * * *